US010073398B2

(12) United States Patent
Yamana

(10) Patent No.: US 10,073,398 B2
(45) Date of Patent: Sep. 11, 2018

(54) IMAGE FORMING APPARATUS HAVING SHUTTER MEMBER FOR OPTICAL SENSOR

(71) Applicant: CANON KABUSHIKI KAISHA, Tokyo (JP)

(72) Inventor: Kentaro Yamana, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/882,086

(22) Filed: Jan. 29, 2018

(65) Prior Publication Data

US 2018/0150011 A1 May 31, 2018

Related U.S. Application Data

(62) Division of application No. 15/134,920, filed on Apr. 21, 2016, now Pat. No. 9,915,903.

(30) Foreign Application Priority Data

Apr. 22, 2015 (JP) ..... 2015-087959

(51) Int. Cl.
*G03G 15/00* (2006.01)

(52) U.S. Cl.
CPC ..... *G03G 15/5054* (2013.01); *G03G 15/5041* (2013.01); *G03G 2215/00042* (2013.01); *G03G 2215/00059* (2013.01); *G03G 2215/00616* (2013.01)

(58) Field of Classification Search
CPC ..... G03G 15/5041; G03G 15/5054; G03G 15/5058; G03G 2215/00059; G03G 2215/00042; G03G 2215/00616
USPC ..... 399/49, 74, 301
See application file for complete search history.

(56) References Cited

U.S. PATENT DOCUMENTS

| | | | |
|---|---|---|---|
| 6,321,044 | B1 | 11/2001 | Tanaka |
| 8,208,826 | B2 | 6/2012 | Takahashi |
| 8,320,023 | B2 | 11/2012 | Takahashi et al. |
| 9,058,002 | B2 | 6/2015 | Takagi et al. |
| 2009/0016762 | A1 | 1/2009 | Ota |

(Continued)

FOREIGN PATENT DOCUMENTS

| | | | |
|---|---|---|---|
| JP | 11-15253 | A | 1/1999 |
| JP | 2009-217229 | A | 9/2009 |

(Continued)

*Primary Examiner* — Robert Beatty
(74) *Attorney, Agent, or Firm* — Fitzpatrick, Cella, Harper & Scinto

(57) ABSTRACT

An image forming apparatus includes optical sensor units provided opposed to an image bearing member; light blockers provided between the image bearing member and the optical sensor units, respectively, the blockers being movable between locking and exposing positions, respectively; calibration members provided where the light is incident when the blockers are in the blocking positions, respectively, the calibration members calibrating data acquired by the optical sensor units; a movable link connected with the blockers; a switching portion for switching the blockers between the exposing and blocking positions; and a positioning portion for determining the blocking position, the positioning portion being disposed at a position where at least one of the blockers is contacted to the positioning portion when the blockers are switched from the exposing positions to the blocking positions.

11 Claims, 4 Drawing Sheets

(56) References Cited

U.S. PATENT DOCUMENTS

| | | | |
|---|---|---|---|
| 2014/0294420 | A1 | 10/2014 | Lee |
| 2015/0277319 | A1 | 10/2015 | Tani et al. |

FOREIGN PATENT DOCUMENTS

| | | | |
|---|---|---|---|
| JP | 2010-014986 | A | 1/2010 |
| JP | 2011-017835 | A | 1/2011 |
| JP | 4724288 | B2 | 7/2011 |
| JP | 2011-227244 | A | 11/2011 |
| JP | 2012-185200 | A | 9/2012 |
| JP | 2014-186118 | A | 10/2014 |

IMAGE FORMING APPARATUS HAVING SHUTTER MEMBER FOR OPTICAL SENSOR

This application is a divisional of U.S. patent application Ser. No. 15/134,920, filed Apr. 21, 2016, which claims the benefit of Japanese Patent Application No. 2015-087959 filed on Apr. 22, 2015, both of which are hereby incorporated by reference herein in their entirety.

FIELD OF THE INVENTION AND RELATED ART

The present invention relates to an image forming apparatus, such as a copying machine and a printer, which uses an electrophotographic, electrostatic, or the like recording method.

Generally speaking, an image forming apparatus which uses an electrophotographic or electrostatic recording method forms a toner image on its image bearing component, which is in the form of a drum or a belt, with the use of an optional image formation process. This toner image is directly transferred (direct transfer type) onto recording medium which is conveyed by a recording medium bearing component, or is temporarily transferred (primary transfer) onto an intermediary transferring component, and then, is transferred (secondary transfer) onto recording medium. As for a recording medium bearing component or an intermediary transferring component, an endless belt is widely in use.

Next, an image forming apparatus of the so-called intermediary transfer type is described further. The image density of this type of image forming apparatus is controlled in the following manner. That is, a toner image (density control patch) for controlling the image forming apparatus in image density is formed, as a referential toner image, in each of the image forming sections of the apparatus, and is transferred onto the intermediary transferring component of the apparatus. Then, the density of this density control patch on the intermediary transferring component is detected by a density sensor of the reflection type, with which the apparatus is provided. Generally speaking, a density sensor of the reflection type has a light emitting section, a light receiving section, and an exposure window which is between these sections and intermediary transferring component. Thus, if the surface of the pane of the exposure window of the density sensor is soiled by the toner scattered from the intermediary transferring component and the like, it becomes impossible for the density sensor to accurately detect the density of the density control patch. That is, the soiling of the surface of the pane of the exposure window of the density sensor results in errors in the detection of the density of the density control patch.

Thus, various attempts have been made to deal with the above-described issue. For example, one of the attempts is disclosed in Japanese Patent No. 4,724,288. According to this patent, the density sensor is provided with a shutter which is for exposing the exposure window of the density sensor to the intermediary transferring component only when the density sensor is actually used. More specifically, a movable shutter having an opening is disposed between the density sensor and intermediary transferring component. This shutter is movable in the direction which is parallel to the lengthwise direction of the density sensor, in such a manner that when the density sensor is actually used, the opening of the shutter is positioned in the light path of the density sensor, whereas when the density sensor is not in use, the opening remains covered by the shutter. However, even a density sensor structured as described above suffers from the following problem. That is, when the density sensor is in use, the shutter is open, and therefore, the exposure window of the density sensor is exposed. Therefore, with the elapse of time, the pane of the exposure window of the density sensor eventually becomes soiled with toner, and therefore, it sometimes occurs that the density of the density control patch is erroneously detected.

One of the solutions to the above-described issue is disclosed in Japanese Laid-open Patent Application No. 2012-185200. According to this patent application, the density sensor is provided with a shutter, and a referential component (referential reflection plate) for adjusting the density sensor in accuracy. The shutter is provided with an opening, and is movable in the direction parallel to the lengthwise direction of the density sensor. Further, the density sensor is structured so that when the exposure window of the density sensor is remaining blocked by the shutter, the referential component opposes the exposure window. Thus, the density sensor can be compensated for the detection error which is attributable to the soiling of the exposure window (window pane) by toner, by adjusting the light emitting section of the density sensor in the amount (intensity) of light, in such a manner that the signal obtained by detection of the beam of light reflected by the referential refection plate becomes equal in strength to the signal (initial signal) obtained by the detection of the beam of light prior to the soiling of the exposure window of the density sensor.

In the case of a structural arrangement in which a shutter such as the above-described one which has an opening and is movable in parallel to the lengthwise direction of the density sensor is provided with the referential reflective plate, if the opening of the shutter and the referential reflective plate are close to each other, toner enters the density sensor through the opening of the shutter, scatters, and soils the reflective referential plate, sometimes making it impossible to properly adjust the density sensor in accuracy. Thus, it is desired that the opening of the shutter and the reflective referential plate are positioned as far as possible from each other. However, such a positional arrangement increases the distance by which the shutter has to be moved between its open and closed positions, and therefore, requires an additional space.

One of the possible solutions to this problem is to structure a density sensor so that the shutter is pivotally movable into a position in which it exposes the exposure window of the density sensor to the intermediary transferring component, or a position in which it blocks the exposure window, by a link which is movable in the direction parallel to the lengthwise direction of the density sensor, and to which the shutter is attached. In the case of this structural arrangement, the amount by which the shutter has to be moved by the movement of the link can be set to a preset value to realize a shutter mechanism which is superior in blocking performance, as well as special efficiency. In the case of a shutter mechanism such as the above describe one, the above-described referential reflective plate is placed on the portion of the surface of the shutter, which faces the exposure window of the density sensor when the shutter is blocking the exposure window.

In the case of a shutter mechanism such as the above-described one, however, the dimensional tolerance for the structural components of the shutter mechanism are amplified by the ratio between the amount by which the shutter is moved by the movement of the link, and the amount of the movement of the link. Therefore, it is possible that the density sensor is reduced in the accuracy with which the referential reflective plate on the shutter is positioned relative to the exposure window of the density sensor. With the density sensor, which employs the referential reflective plate, being reduced in the accuracy in the positioning of the referential reflective plate, the density sensor is low in the accuracy with which it is adjusted in output. That is, it is possible that there will be a substantial amount of error in the density of the density control patch detected by the density sensor.

SUMMARY OF THE INVENTION

According to an aspect of the present invention, there is provided an image forming apparatus comprising a movable image bearing member on which a toner image for adjustment is capable of being formed; a plurality of optical sensor units provided opposed to said image bearing member, said optical sensor units each projecting light to said image bearing member and detecting the light; a plurality of blocking members provided between said image bearing member and said optical sensor units, respectively, said blocking member being movable between a blocking position for blocking said optical sensor unit from said image bearing member and an exposing position for exposing said optical sensor unit toward said image bearing member; a plurality of calibration members provided at positions where the light from said optical sensor units corresponding to the blocking members is incident when said blocking members are in the blocking positions, respectively, said calibration members having predetermined reflection densities, wherein said calibration members are capable of calibrating data acquired by said optical sensor units; a movable link connected with said blocking members; a driving source for applying a force for moving said link; a switching portion configured to switch said blocking members between the exposing positions and the blocking positions, by driving said driving source; and a positioning portion configured to determine the blocking position of said blocking members, said positioning portion being disposed at a position where at least one of said blocking members is contacted to said positioning portion when said blocking members are switched from the exposing positions to the blocking positions.

According to another aspect of the present invention, there is provided an image forming apparatus comprising a movable image bearing member configured to convey a toner image for density adjustment and a toner image for positional deviation adjustment; a first optical sensor unit configured to project light toward said image bearing member and to detect the light projected to the density adjustment toner image; a second optical sensor unit configured to detect the light projected to the positional deviation adjustment toner image; a first blocking member provided between said image bearing member and said first optical sensor unit, said first blocking member being movable between a blocking position for blocking said first optical sensor unit from said image bearing member and an exposing position for exposing said first optical sensor unit toward said image bearing member; a second blocking member provided between said image bearing member and said second optical sensor unit, said second blocking member being movable between a blocking position for blocking said second optical sensor unit from said image bearing member and an exposing position for exposing said second optical sensor unit toward said image bearing member; a calibration member provided at a position where the light from said first optical sensor unit is incident when said first blocking member is in the blocking position thereof, said calibration member having a predetermined reflection density, wherein said calibration member is capable of calibrating data acquired by said first optical sensor unit; a movable link connected with said first blocking member and with said second blocking member; a driving source for applying a force for moving said link; a switching portion configured to switch said first blocking member between the exposing position thereof and the blocking position thereof and to switch said second blocking member between the exposing position thereof and the blocking position thereof, by driving said driving source; and a positioning portion configured to determine the blocking positions of said first and second blocking members, said positioning portion being disposed at the position where said first blocking member is contacted to said positioning portion when said first and second blocking members are switched from the exposing positions to the blocking positions, respectively.

Further features of the present invention will become apparent from the following description of exemplary embodiments with reference to the attached drawings.

Figure 4:
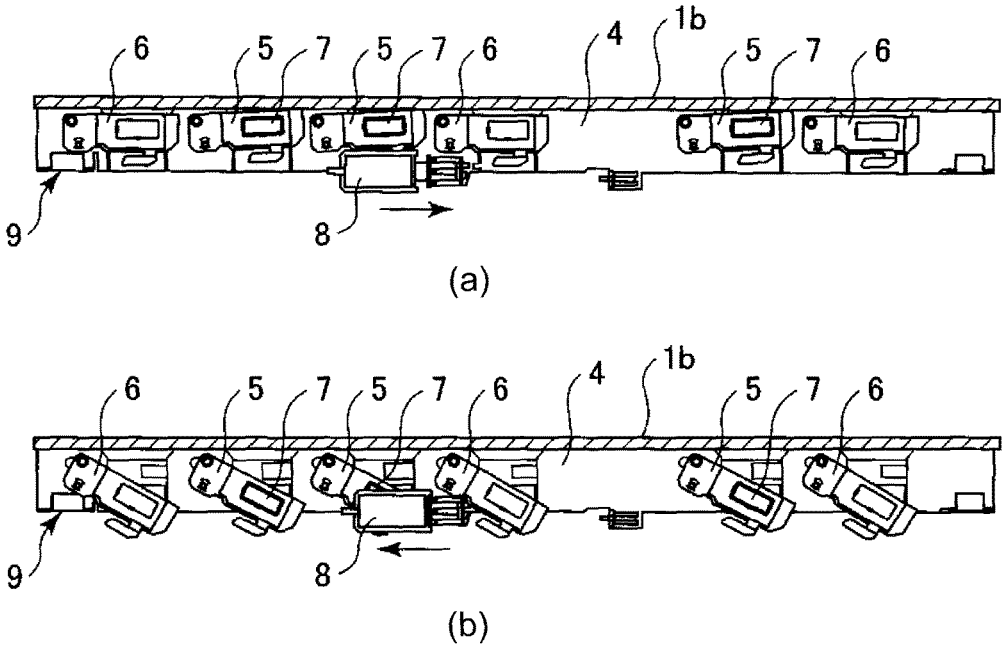

Parts (a) and (b) of FIG. 4 are plan views of the shutter mechanism.

Figure 5:
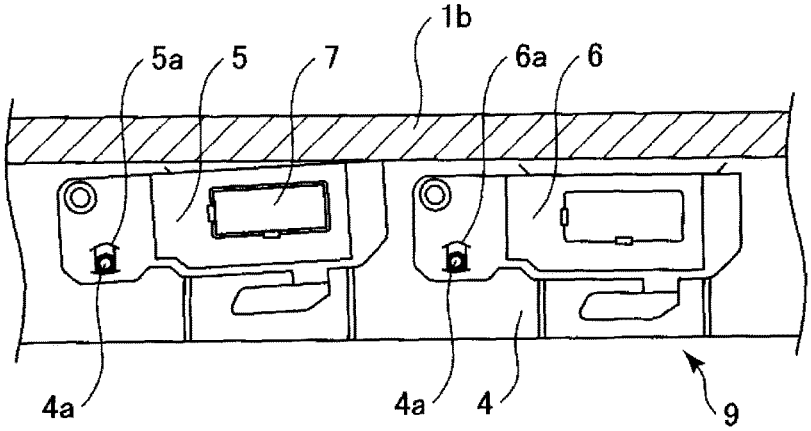

FIG. 5 is an enlarged plan view of the section of the shutter mechanism, which is relevant to the prevent invention.

Figure 6:
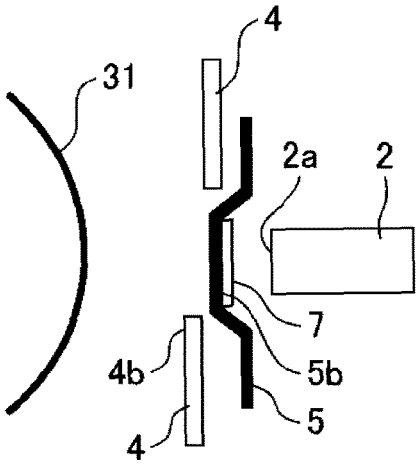

FIG. 6 is a schematic sectional view of the sensor unit at a plane which is perpendicular to the lengthwise direction of the density sensor.

Figure 7:
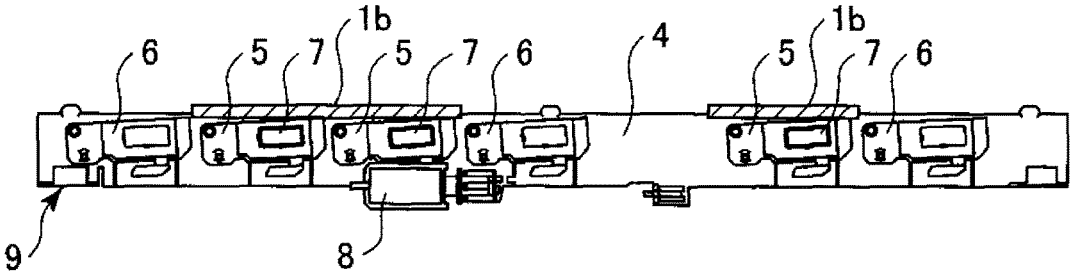

FIG. 7 is a plan view of the shutter mechanism in another embodiment of the present invention.

DESCRIPTION OF THE EMBODIMENTS

Hereinafter, the sensor unit in accordance with the present invention, and the image forming apparatus to which the sensor unit belongs, are described in detail with reference to appended drawings.

[Embodiment 1]

1. Overall Structure and Operation of Image Forming Apparatus

Figure 1:
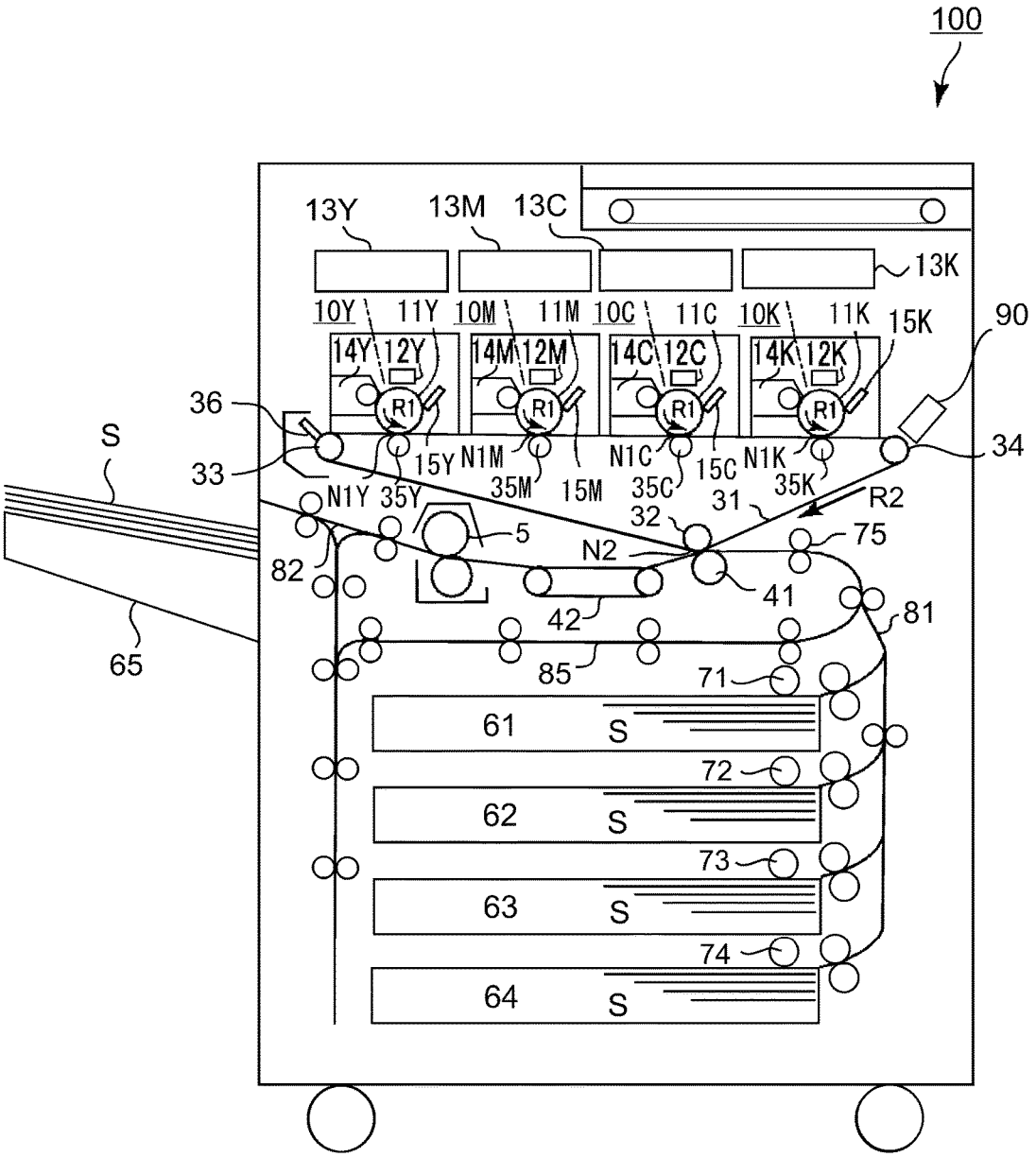
FIG. 1 is a schematic sectional view of a typical image forming apparatus to which the present invention is applicable.

FIG. 1 is a schematic sectional view of the image forming apparatus 100 in the first of preferred embodiments of the present invention. This image forming apparatus 100 is a color image forming apparatus of the so-called intermediary transfer type, and also, of the so-called tandem type. That is, the image forming apparatus 100 has multiple image forming sections, more specifically, the first, second, third and fourth image forming sections 10Y, 10M, 10C and 10K. These image forming sections 10Y, 10M, 10C and 10K are aligned along the horizontal section of the intermediary transfer belt 31 of the image forming apparatus 100. They form yellow (Y), magenta (M), cyan (C) and black (K) images, respectively. The image forming apparatus 100 is enabled to form a full-color image on a sheet S of recording medium such as recording paper with the use of an electrophotographic method, in response to image formation signals sent to the image forming apparatus 100 from an external device.

By the way, the image forming sections 10Y, 10M, 10C and 10K are practically the same in structure and operation, although they are different in the color of the toner they use in a development process. Hereafter, therefore, the suffixes Y, M, C and K, which indicate the color of the monochromatic toner images they form, are eliminated to describe the four image forming sections together, unless the four image forming sections need to be differentiated.

The image forming section 10 has a photosensitive drum 11, as an image bearing component, which is an electrophotographic photosensitive component (which may be referred to simply as photosensitive component, hereafter). The photosensitive drum 11 is in the form of a rotatable drum. The photosensitive drum 11 is rotationally driven in the direction indicated by an arrow mark R1 in FIG. 1. Each image forming section 10 comprises the photosensitive drum 11, and multiple devices for processing the photosensitive drum 11, more specifically, a charging device 12 as a charging means, an exposing device 13 as an exposing means, and a developing device 14 as a developing means, which are disposed in the listed order in terms of the rotational direction of the photosensitive drum 11. There is also disposed a primary transfer roller 35 (primary transferring component), as the primary transferring means, which is in the form of a roller, in the adjacencies of the peripheral surface of the photosensitive drum 11. Moreover, a drum cleaning device 15 is disposed as a photosensitive component cleaning means, on the downstream side of the primary transferring roller 35 in terms of the rotational direction of the photosensitive drum 11.

Further, the image forming apparatus 100 is provided with the intermediary transfer belt 31, as the intermediary transferring component, which is disposed so that it faces each of the four photosensitive drums 11Y, 11M, 11C and 11K. The intermediary transfer belt 31 is an endless belt. It is suspended and kept tensioned by multiple suspending-tensioning rollers, more specifically, a driver roller 33, a tension roller 34, and a belt-backing roller 32 which opposes the secondary transfer roller 41. The intermediary transfer belt 31 is rotationally driven in the direction indicated by an arrow mark R2 in FIG. 1. Each of the above-described primary transfer rollers 35 is on the inward side of the loop which the intermediary transfer belt 31 forms, so that it opposes the corresponding photosensitive drum 11 (11Y, 11M, 11C or 11K). The primary transfer roller 35 forms the primary transferring section N1 in which the photosensitive drum 11 and intermediary transfer belt 31 are in contact with each other, by being pressed against the photosensitive drum 11, with the presence of the intermediary transfer belt 31 between itself and the photosensitive drum 11. Further, the image forming apparatus 100 is provided with the secondary transfer roller 41 (secondary transferring component), as the secondary transferring means, which forms the secondary transferring section N2 in which the intermediary transfer belt 31 and secondary transfer roller 41 contact with each other, by being pressed against the aforementioned belt-backing roller 32, with the presence of the intermediary transfer belt 31 between itself and the belt-backing roller 32. The intermediary transfer belt 31 is an example of component which is movable while bearing a toner image (inclusive of referential toner image). Moreover, in this embodiment, each of the four image forming sections 10Y, 10M, 10C and 10K makes up a toner image forming means for forming a toner image on the intermediary transfer belt 31 as an image conveying component.

The image forming operation of the image forming apparatus 100 is as follows: First, the peripheral surface of the rotating photosensitive drum 11 is roughly uniformly charged by the charging device 12. Then, the charged peripheral surface of the photosensitive drum 11 is exposed to a beam of laser light emitted from the exposing device 13 while being modulated according to the information of the image to be formed. Consequently, an electrostatic latent image (electrostatic image), which reflects the information of the image to be formed, is effected on the peripheral surface of the photosensitive drum 11. Then, the electrostatic latent image is developed into a visible image, that is, an image formed of toner (toner image) by the developing device 14; toner is transferred onto the peripheral surface of the photosensitive drum 11 in the pattern of the electrostatic latent image on the photosensitive drum 11. Then, the toner image on the photosensitive drum 11 is electrostatically transferred (primary transfer) onto the intermediary transfer belt 31 by the function of the primary transfer roller 35, in the primary transferring section N1. The primary transfer residual toner, that is, the toner remaining on the peripheral surface of the photosensitive drum 11 after the primary transfer, is removed from the photosensitive drum 11, and recovered, by the drum cleaning device 15. For example, during an image forming operation in which the image forming apparatus 100 is used for forming a full-color image, four monochromatic toner images, which are different in color, are formed on the photosensitive drums 11Y, 11M, 11C and 11K, respectively, as described above, and are transferred (primary transfer) onto the intermediary transfer belt 31 in a manner to be sequentially layered on the intermediary transfer belt 31.

Meanwhile, the sheets S or recording medium stored in one of sheet-feeding-conveying cassettes 61, 62, 63 and 64 are conveyed to the sheet-feeding-conveying passage 81, by the rotation of one of the sheet-feeding-conveying rollers 71, 72, 73 and 74. Thereafter, a pair of registration rollers 75 conveys each sheet S of recording medium to the secondary transferring section N2, with such timing that the sheet S arrives at the secondary transferring section N2 at the same time as the toner images on the intermediary transfer belt 31. In the secondary transferring section N2, the toner images on the intermediary transfer belt 31 are electrostatically transferred (secondary transfer) onto the sheet S by the function of the secondary transfer roller 41. The secondary transfer residual toner, that is, the toner remaining on the intermediary transfer belt 31 after the secondary transfer is removed from the surface of the intermediary transfer belt 31, and recovered, by the belt cleaning device 36 as a means for cleaning the intermediary transferring component.

The sheet S of recording medium, onto which toner images were transferred, is conveyed to a thermal fixing device 5 by a conveyer belt 42. The thermal fixing device 5 fixes (solidly adheres) the toner images, as a full-color image, for example, on the sheet S to the surface of the sheet S by applying heat and pressure to the sheet S and the toner images thereon. Thereafter, the sheet S is sent out onto a delivery tray 65 through a sheet discharge conveyance passage 82.

The image forming apparatus 100 has a sensor unit 90 for detecting a referential toner image, that is, a toner image for adjustment the density sensor 2. A referential toner image is borne and conveyed by the intermediary transfer belt 31. In this embodiment, a referential density patch (having specific pattern) for controlling the image forming apparatus 100 in image density, and a referential color registration patch, which is for correcting the image forming apparatus 100 in color deviation, are formed on the intermediary transfer belt 31. Thus, the sensor unit 90 is provided with a density sensor and a color registration sensor, each of which is an optical sensor of the reflection type. This setup is described later in detail. In this embodiment, in terms of the rotational direction of the intermediary transfer belt 31, the sensor unit 90 is disposed on the downstream side of the most downstream primary transferring section N1, and on the upstream side of the secondary transferring section N2, so that it opposes the tension roller 34. The density patch and color registration patch formed on the intermediary transfer belt 31 are read by the density sensor and color registration sensor, respectively, for controlling the image forming apparatus 100 in image density and color deviation. As for the method for controlling the image forming apparatus 100 in image density, and the method for correcting the image forming apparatus 100 in color deviation, in this embodiment, they are optional; any known methods may be used. Thus, they are not described in detail here.

2. Sensor Unit

Figure 2:
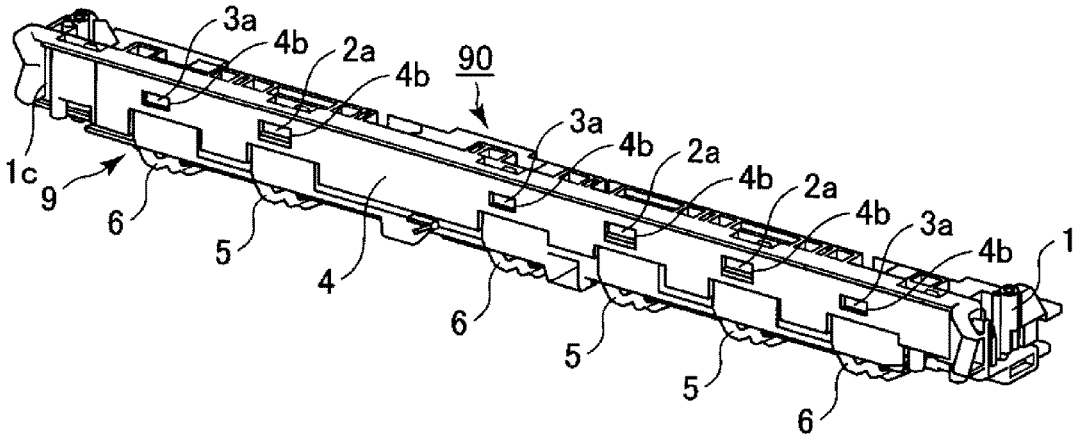
FIG. 2 is a perspective view of the sensor unit in the first embodiment of the present invention.
Figure 3:
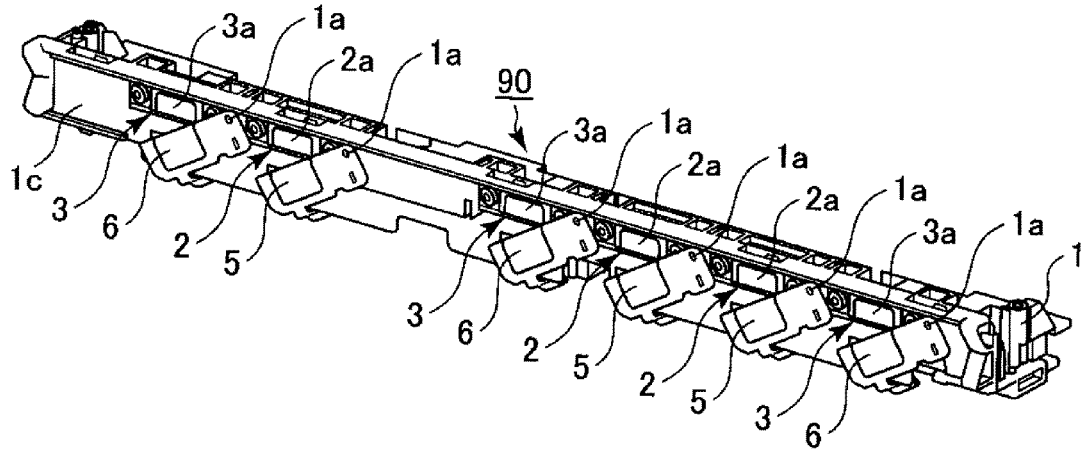
FIG. 3 is a perspective view of the shutter mechanism, in the first embodiment, after the removal of certain components of the mechanism.

Next, the sensor unit 90 in this embodiment is described in greater detail. FIG. 2 is a perspective view of the sensor unit 90. FIG. 3 is a perspective view of the sensor unit 90, after the removal of the shutter link 4 of a shutter mechanism 9, which will be described later. Referring to FIGS. 2 and 3, the sensor unit 90 is disposed so that its surface which faces the intermediary transfer belt 31 appears on the front side of the drawings.

The sensor unit 90 has: a sensor holder 1 as a supporting component; three density sensors 2; three color registration sensors 3; and the shutter mechanism 9 which can switched the shutters in position between an open position in which the shutters expose the density sensors 2 and color registration sensors 3 to the intermediary transfer belt 31, and a closed position in which the shutters cover the density sensors 2 and color registration sensors 3 from the intermediary transfer belt 31.

The sensor holder 1 is a boxy component, and is roughly in the form of a rectangular parallelepiped. It is disposed so that its long edges become intersectional (roughly perpendicular, in this embodiment) to the moving direction of the intermediary transfer belt 31, and also, so that its bottom plate 1*c* faces the intermediary transfer belt 31.

The three density sensors 2 are held to the sensor holder 1 so that the exposure window 2*a* of each density sensor 2 is exposed to the intermediary transfer belt 31 through the openings of the bottom plate 1*c* of the sensor holder 1. Similarly, the three color registration sensors 3 are held to the sensor holder 1 so that the exposure window 3*a* of each color registration sensor 3 is exposed to the intermediary transfer belt 31 through the openings of the bottom plate 1*c* of the sensor holder 1. The three density sensors 2 are aligned in the lengthwise direction of the sensor holder 1, that is, the direction which is intersectional (roughly perpendicular, in this embodiment) to the moving direction of the intermediary transfer belt 31, and so are the three color registration sensors 3. To describe in greater detail, in terms of the lengthwise direction of the sensor holder 1, the three color registration sensors 3 are positioned at the lengthwise ends, and center, of the sensor holder 1, one for one, whereas one of the three density sensors 2 is positioned between one of the lengthwise ends of the sensor holder1, and the center color registration sensor 3, and the other two density sensors 2 are positioned between the other lengthwise end of the sensor holder 1 and the center color registration sensor 3. Each of the density sensors 2 and color registration sensors 3 is an optical sensor of the reflection type. Each density sensor 2 has a light emitting section, a light receiving section, a signal processing circuit, etc. It has also a casing which has an exposure window 2*a*, and in which the light emitting section, light receiving section, signal processing circuit, etc., are disposed. Each color registration sensor 3 has a light emitting section, a light receiving section, a signal processing circuit, etc. It has also a casing which has an exposure window 3*a*, and in which the light emitting section, a light receiving section, signal processing section, etc., are disposed. With regard to the structure of the density sensors 2 and color registration sensors 3, they are optional; any known density sensor and color registration sensor can be employed. Thus, it is not described in detail here.

By the way, in this embodiment, the sensor unit 90 has three density sensors 2 and three color registration sensors 3. However, this embodiment is not intended to limit the present invention in scope in terms of the number of the density sensors 2 and color registration sensors 3; it is not intended to limit the number of the density sensors 2 and color registration sensors 3 to three. That is, the number of the density sensors 2 and color registration sensors 3 may be set according to the design of the image forming apparatus 100.

The shutter mechanism 9 has three first shutters 5, which are disposed so that they correspond in position to the three density sensors 2, one for one. Each of the three shutters 5 is movable so that it can be placed in a position (open position) in which it exposes the exposure window 2*a* of the density sensor 2 to the intermediary transfer belt 31, or a position (closed position) in which it blocks the exposure window 2*a* from the intermediary transfer belt 31. Further, the shutter mechanism 9 has three second shutters 6, each of which is movable in such a manner that it can be moved to a position (open position) in which it exposes the exposure window 3*a* of the corresponding color registration sensor 3 to the intermediary transfer belt 31, or a position (closed position) in which it blocks the exposure window 3*a* of the corresponding color registration sensor 3 from the intermediary transfer belt 31. In this embodiment, the first and second shutters 5 and 6 are practically the same in structure.

The number of the first shutters 5 and the number of the second shutters 6 are to be set according to the number of the density sensors 2 and the number of the color registration sensors 3, respectively. They do not need to be limited to three.

In this embodiment, both the first and second shutters 5 and 6 are pivotally movable about a pivotal boss 1*a* which the bottom plate 1*c* of the sensor holder 1 has. The three first shutters 5 and the three second shutters 6 are in connection to a common shutter link 4 so that they can be moved by the movement of the shutter link 4. The shutter link 4 is held to the sensor holder 1 in such a manner that it is positioned between the first shutters 5 and intermediary transfer belt 31, and also, between the second shutters 6 and intermediary transfer belt 31, and also, that it extends along the bottom plate 1*c* of the sensor holder 1. The shutter link 4 is movable in the direction which is parallel to the lengthwise direction of the sensor holder 1, that is, the direction which is intersectional (roughly perpendicular, in this embodiment) to the moving direction of the intermediary transfer belt 31. The shutter link 4 is such a movable link that is in connection to the first and second shutters 5 and 6. It is an example of such a link that can move the first and second shutters 5 and 6 by its movement, by an amount which is greater than the amount by which it moves.

FIG. 4 is a plan view of the shutter mechanism 9 as seen from the inward side (where density sensors 2 and color registration sensors 3 are present) of the sensor holder 1. Part (a) of FIG. 4 shows the state of the shutter mechanism 9, in which the shutters 5 and 6 are in their closed positions, and part (b) of FIG. 4 shows the state of the shutter mechanism 9, in which the shutters 5 and 6 are in their open position. Further, FIG. 5 is an enlarged view of the combination of the first and second shutters 5 and 6, and their adjacencies, which are at the right end in part (a) of FIG. 4.

The shutter link 4 is moved by a solenoid 8, as a driving section, in the direction which is parallel to the lengthwise direction of the sensor holder 1. Further, the shutters 5 and 6 are provided with elongated holes 5*a* and 6*a*, respectively, in which one of the driving bosses 4*a* with which the shutter link 4 is provided is fitted. Thus, as the shutter link 4 is driven in the direction parallel to its lengthwise direction (linear movement) by the solenoid 8, the first and second shutters 5 and 6 are pivotally moved (pivotal movement) around the pivot boss 1*a* by the movement of the shutter link 4 between their open and closed position.

To describe further, referring to part (b) of FIG. 4, as the moving section of the solenoid 8 moves leftward in the drawing, the shutter link 4 is moved in the same direction, whereby the first and second shutters 5 and 6 are pivotally moved downward in the drawing. Consequently, the shutters 5 and 6 are opened. Referring to FIGS. 2 and 3, when the shutters 5 and 6 are open, the exposure window 2*a* of each density sensor 2, and the exposure window 3*a* of each color registration sensor 3, are exposed to the intermediary transfer belt 31. In this embodiment, as the first and second shutters 5 and 6 are moved roughly 20 mm in the direction which is roughly perpendicular to the moving direction of the shutter link 4 when they are blocking the light passage of the density sensor 2 and color registration sensor 3, respectively, the exposure windows 2*a* and 3*a* become exposed to the intermediary transfer belt 31. The amount of the angle by which the first and second shutters 5 and 6 are pivotally moved during this movement of the shutter link 4 is roughly 30 degrees. Moreover, in this embodiment, the amount by which the shutter link 4 is horizontally moved is roughly 5 mm. Thus, the sensor unit 90 can be reduced in the lengthwise dimension by properly setting the "lever ratio", which is the ratio of the amount of the horizontal movement of the shutter link 4, relative to the amount of the vertical movement of the first and second shutters 5 and 6 (in this embodiment, horizontal movement:vertical movement=1:4). Further, with the usage of this structural arrangement, it is possible to reduce the solenoid 8 in size, and therefore, it is possible to reduce the amount of space which the image forming apparatus 100 occupies.

FIG. 6 is a schematic sectional view of the sensor unit 90, at a plane which coincides with the exposure window 2*a* of the density sensor 2, and also, is perpendicular to the exposure window 2*a*. The density sensor 2 is provided with a referential reflection plate 7 which is a referential component for compensating for the density sensor 2. The referential reflection plate 7 is attached to the portion of the surface 5*b* of the first shutter 5, which directly faces the density sensor 2 when the first shutter 5 is in the position in which it blocks the density sensor 2 from the intermediary transfer belt 31, when the first shutter 5 is remaining closed. That is, the referential reflection plate 7 is positioned so that when the first shutter 5 is in the closed position, the referential reflection plate 7 blocks the light passage of the density sensor 2. In this embodiment, the amount by which light is emitted from the light emitting section of the density sensor 2 is adjusted so that the signal obtained by detecting the light reflected by the referential reflection plate becomes equal in strength to the signal obtained before the exposure window 2*a* was soiled by toner. Thus, the density sensor 2 is compensated for the error in the detection of the density of the density patch, which occurs as the exposure window 2*a* is soiled by toner.

Next, referring to FIGS. 2 and 6, in this embodiment, the shutter link 4 is disposed so that it is positioned between the first shutter 5 and intermediary transfer belt 31, and also, between the second shutter 6 and intermediary transfer belt 31. That is, it is disposed so that as it is seen from the direction of the intermediary transfer belt 31, it covers the first and second shutters 5 and 6. Therefore, when the first shutter 5 is in the closed state, the shutter link 4 is between the referential reflection plate 7 of the first shutter 5 and the intermediary transfer belt 31, preventing thereby the referential reflection plate 7 from being soiled by scattered toner. Therefore, it is possible for the surface of the referential reflection plate 7 to remain in its initial state for a long time. Moreover, the shutter link 4 has six holes 4*b*, which correspond in position to the three density sensors 2 and three color registration sensors 3, one for one. These holes 4*b* are positioned so that when the shutters 5 and 6 are in the open state, the exposure window 2*a* of each density sensors 2 and the exposure window 3*b* of each color registration sensor 3, are exposed to the intermediary transfer belt 31 through the corresponding hole 4*b*. In this embodiment, even when the shutters 5 and 6 are in the open state, the shutter link 4 covers each of the first and second shutters 5 and 6 at least partially. Therefore, even when the shutters 5 and 6 are in the open state, the shutter link 4 can at least partially block between the referential reflection plate 7 of the first shutter 5 and the intermediary transfer belt 31.

Next, referring to part (a) of FIG. 4, as the moving section of the solenoid 8 moves rightward in the drawing, the shutter link 4 is moved in the same direction, whereby the first and second shutters 5 and 6 are pivotally moved upward in the drawing. Consequently, the shutters 5 and 6 are closed. In this embodiment, the bottom plate 1*c* of the sensor holder 1 is provided with a stopper 1*b*, which is on the downstream end of the sensor holder 1 in terms of the direction in which the first and second shutters 5 and 6 pivotally move from their open position to their closed position, and which extends straight roughly from one lengthwise end of the sensor holder 1 to the other. Further, the image forming apparatus 100 is structured so that when the state of the first shutter 5 and second shutter 6 are changed by the shutter mechanism 9 from the open one to the closed one, each of the first shutters 5 which have the referential reflection plate 7 comes into contact with the stopper 1*b* ahead of each of the second shutters 6, preventing thereby the second shutters 6 from coming into contact with the stopper 1*b*.

Referring to FIG. 5, in this embodiment, the sensor unit 90 is structured so that when both the first shutter having the referential reflection plate 7, and the second shutter 6, are in their open position, the angle of the first shutter 5 relative to the stopper 1*b*, is smaller than the angle of the second shutter 6 relative to the stopper 1*b*. With the provision of this difference between the first and second shutters 5 and 6 in terms of their angle relative to the stopper 1*b*, it is ensured that when the shutter mechanism 9 changes the state of the first and second shutters 5 and 6 from the open one to the closed one, the first shutter 5 comes into contact with the stopper 1*b* ahead of the second shutter 6, stopping thereby the shutter mechanism 9 in the state in which the shutter mechanism 9 keeps both the first and second shutters 5 and 6 closed.

Therefore, the position into which first shutter 5 having the referential reflection plate 7 is moved as it is closed is determined by the direct contact between the first shutter 5 and stopper 1*b*. Therefore, the referential reflection plate 7 is precisely positioned relative to the density sensor 2.

Here, "the state in which the shutter mechanism 9 will be when the first and second shutters 5 and 6 are closed is realized by the contact between the first shutter 5 and stopper 1*b*" does not means that the moment the first shutter 5 comes into contact with the stopper 1*b*, all the structural components of the shutter mechanism 9 become frozen in position. That is, the shutter mechanism 9 may be structured so that even after the first shutter 5 becomes fixed in position by coming into contact with the stopper 1*b* during the closing of the shutters 5 and 6, at least one among the solenoid 8, shutter link 4, and second shutter 6, for example, is afforded a certain amount of play. In other words, all that is necessary is that the shutter mechanism 9 is not structured so that the position into which the first shutter 5 is locked as it is completely closed is not determined by the position into which the structural components of the shutter mechanism 9, other than the first shutter 5, are moved.

On the other hand, it is possible to structure the shutter mechanism 9 so that the state into which the shutter mechanism 9 is placed as the first and second shutters 5 and 6 are moved into their closed positions is controlled by the contact between the shutter link 4 and sensor holder 1, or the contact between the second shutter 6 and sensor holder 1, unlike in the first embodiment. In this case, not only are the tolerances in the measurement of the shutter link 4, first shutter 5, and second shutter 6 compounded, but also, the tolerances are amplified by the above-described lever ratio. Thus, the sensor unit 90 is reduced in the accuracy in terms of the position into which the first shutter 5 is moved, that is, the position into which the referential reflection plate 7 is moved, as the first shutter 5 is closed by the shutter mechanism 9. Therefore, it sometimes occurs that the density sensor 2 increases in the amount of error in the detection of the density detection patch.

In this embodiment, the sensor unit 90 is provided with multiple first shutters 5. Therefore, as the shutter link 4 is moved in the closing direction, one of the first shutters 5 comes into contact with the stopper 1*b* ahead of the others. All that is necessary to deal with this issue is to structure the sensor unit 90 in consideration of only the difference in position among the multiple first shutters 5 so that the amount by which light is reflected by the referential reflection plate 7 becomes proper whether the compound tolerance becomes maximum when the shutters 5 and 6 are open or closed. By the way, the sensor unit 90 may be structured so that two or more first shutters 5 come into contact with the stopper 1*b* ahead of, or roughly at the same time as, the second shutter 6. However, as long as the sensor unit 90 is structured so that at least one of the multiple first shutters 5 comes into contact with the stopper 1*b* ahead of the second shutter 6, effects which are similar to those obtained by the preceding structural arrangement can be obtained.

As described above, according to this embodiment, it is possible to improve the sensor unit 90 in accuracy in terms of the positional relationship between the referential component, with which the shutter 5 is provided for adjusting the optical sensor 2, and optical sensor 2, while reducing the sensor unit 90 in size (amount of space it occupies), by structuring the sensor unit 90 so that as the shutter link 4 is moved, the shutters 5 are moved by the shutter link 4 by a substantially greater amount than the amount by which the shutter link 4 is moved.

[Embodiment 2]

Next, another embodiment of the present invention is described. The image forming apparatus 100 in this embodiment is basically the same in structure and operation as that in the first embodiment. Therefore, the components of the image forming apparatus 100 in this embodiment, which are the same as, or correspondent to, the counterparts in the first embodiment, in function and structure, are given the same referential codes as those given to the counterparts, and are not described here.

FIG. 7 is a plan view of the shutter mechanism 9 of the sensor unit 90 in this embodiment, as seen from the inward side (where density sensor 2 and color registration sensor 3 are present) of the sensor holder 1.

In this embodiment, the sensor holder 1 is provided with a pair of stoppers 1*b*, which correspond in position only to the density sensors 2. Therefore, it does not occur that the second shutters 6 provided for the color registration sensors 3 come into contact with the sensor holder 1. In this embodiment, therefore, it is unnecessary to make the first shutters 5 different from the second shutters 6 in the angle relative to the sensor holder 1 as in the first embodiment.

As described above, not only can this embodiment provide the same effects as the first embodiment, but also, it can make the sensor unit 90 easier to assemble.

[Miscellanies]

In the foregoing, the present invention was described with reference to the preferred embodiments of the present invention. However, the preceding embodiments are not intended to limit the present invention in scope.

In the above-described embodiments, the sensor unit was for detecting the referential toner image which is borne on the intermediary transferring component, as a conveying component, and is conveyed to the sensor unit. However, the preceding embodiments are not intended to limit the present invention in scope in terms of the type of the sensor unit to which the present invention is applicable. For example, the present invention is also applicable to such a sensor that detects a referential toner image which is borne and conveyed by a recording medium bearing component. As for the recording medium bearing component, an endless belt similar to the intermediary transferring component in the above-described embodiments is widely used.

Also in the above-described embodiments, the sensor unit 90 had density sensors and color registration sensors. However, the present invention is also applicable to a sensor unit having only density sensors. In such a case, a sensor unit is provided with only the first shutters which correspond to the density sensors, one for one. Further, such a sensor may be for detecting a referential toner image which is borne and conveyed by a photosensitive component or an electrostatically recordable dielectric component, as a conveying component. Further, the present invention is also applicable to a senor unit for detecting any referential toner image.

Moreover, the preceding embodiments are not intended to limit the choice of intermediary transferring component and/or recording medium conveying component of the image forming apparatus to which the present invention is applied, to an endless belt. For example, the present invention is also applicable to an image forming apparatus, the intermediary transferring component and/or recording medium bearing component of which is in the form of a drum made up of a frame and a sheet of film stretched around the frame. Moreover, the preceding embodiments are not intended to limit the choice of photosensitive component of an image forming apparatus to which the present invention is applied, to a photosensitive drum. That is, the present invention is also applicable to an image forming apparatus, the photosensitive component of which is in the form of an endless belt or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a movable image bearing member on which a toner image for adjustment is capable of being formed;

an optical sensor unit including a light emitting portion and a light receiving portion provided opposed to said image bearing member, said light emitting portion projecting light from a window of said optical sensor unit toward said image bearing member and said light receiving portion detecting the light reflected by the toner image;

a shutter provided between said image bearing member and said optical sensor unit, said shutter being movable between a closing position for closing the window and an opening position for opening the window;

a reflection portion having a predetermined reflection density provided on said shutter and provided at a position where the light from said light emitting portion is incident when said shutter is in the closing position, wherein an amount of the light emitted from said light emitting portion is adjusted on the basis of a signal obtained by detecting the light reflected by said reflection portion;

a slideable link connected with said shutter, said shutter being rotatable between the opening position and the closing position in conjunction with said link; and a stopper configured to stop movement of said shutter at the closing position by contacting with said shutter.

2. The apparatus according to claim 1, wherein said link is movable along a line extending substantially in parallel with a widthwise direction which is perpendicular to a moving direction of said image bearing member.

3. The apparatus according to claim 1, further comprising a supporting member supporting said optical sensor unit, wherein said stopper is provided on said supporting member.

4. The apparatus according to claim 3, wherein said link is provided, at a position opposing said optical sensor unit when said shutter is in the opening position, with an opening for permitting passage of the light from said optical sensor unit to said image bearing member.

5. The apparatus according to claim 4, wherein said link at least partly covers spaces between said image bearing member and said reflection portion, when said shutter is in the opening position.

6. The apparatus according to claim 1, wherein a movement distance of said shutter between the opening position and the closing position is longer than a movement distance of said link at the time when said shutter moves from the opening position to the closing position.

7. An apparatus according to claim 1, wherein said image bearing member is an intermediary transfer belt configured to temporarily carry the toner image to be transferred onto a recording material, or a feeding belt configured to feed the recording material.

8. An image forming apparatus comprising:

a movable image bearing member on which a toner image for adjustment is capable of being formed;

an optical sensor unit including a light emitting portion and a light receiving portion provided opposed to said image bearing member, said light emitting portion projecting light from a window of said optical sensor unit toward said image bearing member and said light receiving portion detecting the light reflected by the toner image;

a shutter provided between said image bearing member and said optical sensor unit, said shutter being movable between a closing position for closing said light receiving portion and an opening position for opening said light receiving portion;

a reflection portion having a predetermined reflection density provided on said shutter and provided at a position where the light from said light emitting portion is incident when said shutter is in the closing position, wherein an amount of the light emitted from said light emitting portion is adjusted on the basis of a signal obtained by detecting the light reflected by said reflection portion;

a slideable link connected with said shutter, said shutter being rotatable between the opening position and the closing position in conjunction with said link; and a stopper configured to stop movement of said shutter at the closing position by contacting with said shutter.

9. An image forming apparatus comprising:

a movable image bearing member configured to convey a toner image for density adjustment and a toner image for positional deviation adjustment;

a first optical sensor unit including a first light emitting portion and a first light receiving portion configured to project first light toward said image bearing member and to detect the first light reflected by the density adjustment toner image;

a second optical sensor unit including a second light emitting portion and a second light receiving portion configured to project second light toward said image bearing member and to detect the second light reflected by the positional deviation adjustment toner image;

a first shutter provided between said image bearing member and said first optical sensor unit, said first shutter being movable between a first closing position for closing said first light receiving portion from said image bearing member and a first exposing position for exposing said first light receiving portion to said image bearing member;

a second shutter provided between said image bearing member and said second optical sensor unit, said second shutter being movable between a second closing position for closing said second light receiving portion from said image bearing member and a second exposing position for exposing said second light receiving portion to said image bearing member;

a reflection portion having a predetermined reflection density provided on said first shutter and provided at a position where the first light from said first light emitting portion is incident when said first shutter is in the first closing position, wherein an amount of the first light emitted from said first light emitting portion is adjusted on the basis of a signal obtained by detecting the first light reflected by said reflection portion;

a slideable link connected with said first shutter and with said second shutter, wherein said first and second shutters are rotatable, respectively, in conjunction with said link; and a stopper configured to stop movement of said first shutter at the first closing position by contacting with said first shutter.

10. An image forming apparatus comprising:

a movable image bearing member configured to convey a toner image;

a first optical sensor unit including a first light emitting portion and a first light receiving portion configured to project first light toward said image bearing member and to detect the first light reflected by a first adjustment toner image;

a second optical sensor unit including a second light emitting portion and a second light receiving portion configured to project second light toward said image bearing member and to detect the second light reflected by a second adjustment toner image;

a first shutter provided between said image bearing member and said first optical sensor unit, said first shutter being movable between a first closing position for closing said first light receiving portion from said image bearing member and a first exposing position for exposing said first light receiving portion to said image bearing member;

a second shutter provided between said image bearing member and said second optical sensor unit, said second shutter being movable between a second closing position for closing said second light receiving portion from said image bearing member and a second exposing position for exposing said second light receiving portion to said image bearing member;

a reflection portion having a predetermined reflection density provided on said first shutter and provided at a position where the first light from said first light emitting portion is incident when said first shutter is in the first closing position, wherein an amount of the first light emitted from said first light emitting portion is adjusted on the basis of a signal obtained by detecting the first light reflected by said reflection portion;

a slideable link connected with said first shutter and with said second shutter, wherein said first and second shutters are rotatable, respectively, in conjunction with said link; and a stopper configured to stop movement of said first shutter at the first closing position by contacting with said first shutter.

11. An image forming apparatus comprising:

a movable image bearing member configured to convey a toner image;

a first optical sensor unit including a first light emitting portion and a first light receiving portion configured to project first light toward said image bearing member and to detect the first light reflected by a first adjustment toner image;

a second optical sensor unit including a second light emitting portion and a second light receiving portion configured to project second light toward said image bearing member and to detect the second light reflected by a second adjustment toner image;

a first shutter provided between said image bearing member and said first optical sensor unit, said first shutter being movable between a first closing position for closing said first light receiving portion from said image bearing member and a first exposing position for exposing said first light receiving portion to said image bearing member;

a second shutter provided between said image bearing member and said second optical sensor unit, said second shutter being movable between a second closing position for closing said second light receiving portion from said image bearing member and a second exposing position for exposing said second light receiving portion to said image bearing member;

a reflection portion having a predetermined reflection density provided on said first shutter and provided at a position where the first light from said first light emitting portion is incident when said first shutter is in the first closing position;

a slideable link connected with said first shutter and with said second shutter, wherein said first and second shutters are rotatable, respectively, in conjunction with said link; and a stopper configured to stop movement of said first shutter at the first closing position by contacting with said first shutter.

* * * * *